United States Patent [19]

Vandenberghe et al.

[11] 4,001,026

[45] Jan. 4, 1977

[54] METHOD AND MATERIALS FOR THERMOPLASTIC RECORDING

[75] Inventors: Antoon Leon Vandenberghe, Hove; Frans Clement Heugebaert; Albert Lucien Poot, both of Kontich, all of Belgium

[73] Assignee: Agfa-Gevaert N.V., Mortsel, Belgium

[22] Filed: June 24, 1975

[21] Appl. No.: 589,695

Related U.S. Application Data

[63] Continuation of Ser. No. 369,125, June 12, 1973, abandoned.

[30] Foreign Application Priority Data

June 13, 1972 United Kingdom ..... 27656/72

[52] U.S. Cl. ..... 96/114.1; 96/95; 96/66 R

[51] Int. Cl.[2] ..... E03C 1/02; E03C 5/30

[58] Field of Search ..... 96/114.1, 66 R, 95; 250/316, 317, 318; 427/146, 150, 151, 152

[56] References Cited

UNITED STATES PATENTS

| | | | |
|---|---|---|---|
| 3,186,843 | 6/1965 | Haas | 96/66 R |
| 3,218,166 | 11/1965 | Reitter | 96/114.1 |
| 3,547,648 | 12/1970 | Sagawa | 96/114.1 |
| 3,790,383 | 2/1974 | Shimamura et al. | 96/66 R |
| R27,375 | 5/1972 | Puerckhauer et al. | 96/114.1 |

*Primary Examiner*—Mary F. Kelley
*Attorney, Agent, or Firm*—William J. Daniel

[57] ABSTRACT

A sheet material including in working relationship with a reducible silver salt a sterically hindered phenol derivative having the following structural formula:

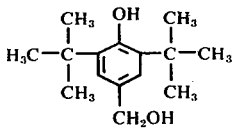

9 Claims, No Drawings

METHOD AND MATERIALS FOR THERMOPLASTIC RECORDING

This is a continuation of Ser. No. 369,125, filed June 12, 1973, now abandoned.

The present invention relates to a method for recording and reproducing information by means of heat and a material suited for use in such method.

In common thermography a heat-sensitive sheet is brought into face to face contact with a graphic original which carries an image formed of infrared-absorbing material. When the original is exposed to infrared radiation, the image portions thereof are selectively heated and cause the development in the adjacent heat-sensitive sheet of a colour pattern corresponding to the orginal.

In another type of recording and reproduction of information involving heat a colour-forming component of a copy sheet is rendered inactive and non-transferable by heat by exposure to short wavelength radiation. The colour-forming compound left in the unexposed or less exposed portions is transferred by heat to a receptor sheet on which it causes colour formation. This latter type of system has the advantage that the final copy is non heat-sensitive, as the reactivity of the colour-forming component has been destroyed imagewise by the short wavelength radiation. It is primarily to this type of system that the present invention is directed.

It is also possible to apply a single sheet system by using a coating containing reactive components, one of which is rendered inactive by exposure to short wavelength radiation. Known systems of this type are described by Lawton and Lopex, U.S. Pat. No. 3.076,707 and by Grant, U.S. Pat. No. 3,094,619 which utilize colour- forming systems employing diazonium compounds and alpha naphthols respectively. In these systems the copy sheet may be exposed to a short wavelength, e.g. ultraviolet radiation image of the original to be copied to inactivate at least one of the components, and then overall heated to develop colour in the areas, where the components remain reactive. Alternatively, the copy sheet may be initially exposed to infrared radiation while being in contact with the graphic original, to bring about a colour-forming reaction in the areas in contact with the black parts of the original, and subsequently exposed to short wavelength radiation to inactivate the unreacted parts of the sheet.

Two-sheet systems are exemplified by Benbrook, U.S. Pat. No. 2,789,904 and Workman, U.S. Pat. No. 3,094,417, in which a photosensitive reductor susceptible of being deactivated by exposure to short wavelength radiation is carried on a sheet (called hereinafter copy sheet) separate from the sheet that carries the material with which it enters into a colour-forming reaction. In the two-sheet system, the sheet containing the deactivatable reductor is first exposed to a short wave radiation image of the original to be copied to cause deactivation of the reductor in the exposed portions. This sheet is then brought into contact with a sheet containing the other colour-forming components and heated to bring about a colour-forming reaction in the unexposed areas. This two-sheet system requires that the photosensitive reductor, when heated, will be transferred sufficiently from one sheet to the other to bring about the colour-forming reaction.

The present invention is based on the discovery that the thermal colour formation by means of photosensitive reductors applicable in the latter system and a reducible heavy metal salt such as a silver soap can be improved by the presence of an auxiliary reducing agent being a sterically hindered phenol derivative corresponding to the following structural formula

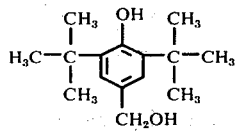

The 2,6-di-tert.butyl-4-hydroxymethylphenol is prepared e.g. according to J.Am.Chem.Soc.75 (1953) 734, or to U.S. Pat. No. 3,030,428. Melting point: 141° C.

The said sterically hindered phenol derivative retains its reducing properties even after exposure to either ultraviolet radiation or actinic light.

Fairly low concentrations of the present reducing agent may be employed so that it will reduce a silver metal soap under normally employed reaction temperature only in the presence of a photosensitive reducing agent.

The silver metal images obtained by means of the present reductor used as auxiliary reducing agent have a markedly improved colour density as compared to images prepared without said reducing agent.

The above-mentioned sterically hindered phenol derivative can be used in any known heat-sensitive copying material or image-receiving material in an amount suited for obtaining a desired reducing effect, e.g. in the presence of other reducing agents and in conjunction with reducible compounds e.g. silver salts or other heavy metal salts incorporated in a binder as described, e.g., in the U.S. Pat. Nos. 2,910,377 and 3,218,166, in the United Kingdom Pat. Nos. 954,198, 1,110,046 and 1,110,046 and in the German Pat. application No. P 2106577 and P 2140462.

For example the mentioned sterically hindered phenol can be used in combination with the known organic reducing agents containing an active hydrogen atom linked to O, N or C, e.g. with o-alkyl- or cycloalkyl phenols, di- and trihy- droxyaryl-, aminophenol-, aminonaphthol-, p-phenylenediamine and hydroxylamine derivatives, gallates, alkoxynaphthols, acetoacetonitriles, pyrazolidin-3-one as well as pyrazolin 5-one, indanedione-1,3 derivatives, hydroxytetrone acids, hydroxytetronimides, reductones e.g. anhydrodihydro- pyrrolidinohexosereductones, derivatives of ascorbic acid and hydroxychroman or hydroxy, cumaran, e.g. according to published German Patent Application (DOS) 2031748; e.g. o-alkylphenols, hydroquinone, aminophenol derivatives and methoxynaphthol derivatives, bis-$\beta$-naphthols, hydroxy-cumaran and hydroxychroman are preferred.

Suitable photosensitive reductors for silver metal soaps that are advantageously combined with the present auxiliary reducing agent(s) are those which are rendered inactive and non-transferable by heat through an exposure to short wavelength radiation such as the naphthols disclosed in U.S. Pat. No. 3,094,417 to Workman, the pyrazolin-5-ones disclosed in the published German Patent Application (DOS) No. 2,117,053 the reducing agents of the indane-dione-1,3 type described in the published German Patent Application (DOS) No. 2,152,607 or an acetoacetonitrile derivative disclosed in the published German Patent Application (DOS) No. 2,010,837 preferably within the scope of the following general formula:

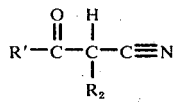

wherein:

R′ is an alkyl group e.g. methyl including a substituted alkyl group, an aralkyl group e.g. benzyl, an alkoxy- carbonyl group, an alkoxy group or an aromatic group including a substituted aromatic group e.g. a methoxy-substituted phenyl group, and $R_2$ represents an aromatic or heterocyclic group including said groups in substituted form e.g. a phenyl group, a pyridyl group, a furyl group or a thienyl group, or any other compound that reacts to form a coloured product with a reducible metal salt, preferably a silver salt of an aliphatic carboxylic acid containing at least 14 carbon atoms, e.g. silver behenate or silver stearate. Suitable reactive silver salts are disclosed e.g. in U.S. Pat. No. 3,094,417.

Other suitable colour-forming reaction partners than silver metal salts and that may be used in a receptor sheet to which unaffected photosensitive reductor is transferred by overall heating following the image-wise photo-exposure are described in the published German patent application (DOS) No. 2,117,053.

The photosensitive reductor of the copy sheet can be desensitized by exposure to ultraviolet radiation, but may be rendered sensitive to actinic radiation of longer wavelength, for instance that from a tungsten filament lamp, by introducing a dye sensitizer in accordance with well known photochemical technology. Dye sensitizers of the erythrosin family have been found to be quite suitable, but others may be used e.g. those described in the published German Patent Application (DOS) No. 2,106,577.

The present sterically hindered phenol derivative is preferably combined with a reducible silver salt in a suitable binder, e.g. polyvinyl butyral or poly-tert.butyl methacrylate, and applied to a supporting sheet of paper or the like to form a receptor sheet.

The sterically hindered phenol derivative is preferably used in an amount of at least 10 % by weight with respect to the reducible silver salt.

The receptor sheet used in conjunction with the photo-sensitive copy sheet may contain, in addition to the colour-forming reactant and auxiliary reductor, a so-called toning agent, e.g. 1-(2H)-phthalazinone, a phthalazinone derivative or phthalimide as described e.g. in the German Patent Application (DOS) Nos. 21 40 462, 21 40 063, 22 206 18 and 22 61 739 which toning agents provide a more neutral image colour tone.

In order to obtain the desired visible image formation the receptor sheet and image-wise exposed copy sheet are heated within the temperature range of 50° to 200° C.

The following Examples illustrate the present invention. The percentages are by weight unless otherwise indicated.

EXAMPLE 1

To a map overlay tracing paper the following composition was applied in a ratio of 25 g/sq.m:

| | |
|---|---|
| 4-methoxy-1-naphthol | 1 g |
| erythrosin | 440 mg |
| ethylcellulose | 50 g |
| methyl ethyl ketone up to | 500 g. |

After drying the photosensitive coating of the copy sheet was exposed in reflex to a graphic original having differentially light-absorptive image and background areas. The copy sheet was hereby placed with its coated surface in contact with the printed text of the opaque original. The exposure lasted 30 sec. and was effected by means of a tungsten filament light source of 1500 Watt placed at a distance of 5 cm from the copy sheet.

Subsequently the irradiated sheet was pressed for 5 sec. with its photosensitive layer in contact at 125° C with a receptor sheet, which was prepared as follows: the following ingredients were ball-milled for 4 hours:

| | |
|---|---|
| stearic acid | 2.25 g |
| ELVACITE 2046 (a copolymer of n-butylmethacrylate and isobutyl methacrylate) (marketed by E.I. du Pont de Nemours & Co., Wilmington, Delaware, USA) | 12.2 g |
| phthalazinone | 2.9 g |
| zinc oxide | 52.60 g |
| silver stearate | 11.5 g |
| ethyl acetate | 245 g. |

Thereupon the following solution of auxiliary reducing agent was added:

| | |
|---|---|
| 2,6-di-tert.butyl-4-hydroxymethylphenol | 2.85 g |
| acetone | 25 g. |

The obtained mixture being first diluted with 600 g of ethyl acetate was applied to a paper support at a coverage of 100 g per sq.m.

The dried receptor sheet was heated in contact with a 3M Dual Spectral Pink Sheet as described by Workman, U.S. Pat. No. 3,094,417, previously exposed as described therein. The resultant image obtained on the receptor sheet in accordance with the present Example had a greatly improved colour density as compared to a sheet formed and exposed in the manner described and not containing the auxiliary reducing agent. An improved thermal stability of the receptor sheet material was obtained when compared with a receptor sheet containing as auxiliary reducing agent 2,6-di-tert.butyl-4-methylphenol.

Same result was obtained by using silver behenate instead of silver sterate in the receptor sheet.

EXAMPLE 2

Example 1 was repeated with the difference, however, that as light-sensitive copy sheet a sheet material was used consisting of a thin glassine paper base coated with the following photosensitive composition:

| | |
|---|---|
| erythrosin | 0.01 g |
| 2(p-chloro-phenyl)-acetoacetonitrile | 0,2 g |

-continued

| | |
|---|---|
| ethylcellulose (Hercules N-10) | 5 g |
| ethyl acetate | 50 g. |

The composition was applied at a coverage of 0.01 lbs. per square feet and dried.

We claim:

1. A sheet material carrying a layer comprising an ad-mixture of a reducible silver salt and a sterically hindered phenol derivative having the following structural formula:

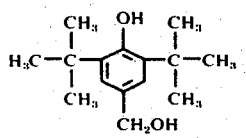

said silver salt being a silver salt of an aliphatic carboxylic acid containing at least 14 carbon atoms.

2. A method for recording and reproducing information comprising the steps of image exposing to ultraviolet or actinic radiation a photosensitive recording element comprising a photodeactivatable reductor capable of reducing a silver salt at elevated temperature, and uniformly heating said exposed element while the same is in intimate contact with an image-forming layer comprising an admixture of a reducible silver salt and a sterically hindered phenol derivative having the following structural formula:

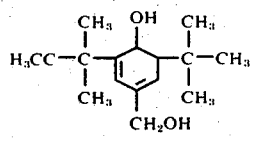

said silver salt being a silver salt of an aliphatic carboxylic acid containing at least 14 carbon atoms, and said reductor being a naphthol, a pyrazolin-5-one, an indane-dione-1,3, or an acetoacetonitrile compound, deactivated by said radiation exposure.

3. A sheet material according to claim 1, wherein the silver salt is silver behenate or silverstearate.

4. A sheet material according to any of claim 1, wherein the phenol derivative is present in said material in an amount of at least 10% by weight with respect to the silver salt.

5. A sheet material according to claim 1, wherein the phenol derivative and reducible silver salt admixture is in a binder layer applied to a paper support.

6. A sheet material according to claim 5. wherein said phenol derivative and silver salt are used in conjunction with a toning agent.

7. A recording process according to claim 2, wherein the silver salt is silver behenate or silver stearate.

8. A recording process according to claim 2, wherein the phenol derivative is used in an amount of at least 10 % by weight with respect to the silver salt.

9. A recording process according to claim 2, wherein the sheet material is heated in a temperature range of 50° to 200° C.

* * * * *

UNITED STATES PATENT AND TRADEMARK OFFICE

CERTIFICATE OF CORRECTION

PATENT NO. : 4,001,026

DATED : January 4, 1977

INVENTOR(S) : Antoon Leon Vandenberghe et al

It is certified that error appears in the above–identified patent and that said Letters Patent are hereby corrected as shown below:

Claim 2, line 2, "image" should read -- image-wise --.

Claim 4, line 1, "any of" should be cancelled.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*